US005803289A

United States Patent [19]

Brady

[11] Patent Number: 5,803,289

[45] Date of Patent: Sep. 8, 1998

[54] CONTAINER HAVING DISAPPEARING AND REAPPEARING INDICIA

[75] Inventor: Thomas E. Brady, Sylvania, Ohio

[73] Assignee: Plastic Technologies, Inc., Holland, Ohio

[21] Appl. No.: 892,279

[22] Filed: Jul. 14, 1997

Related U.S. Application Data

[60] Provisional application No. 60/022,651, Jul. 26, 1996.

[51] Int. Cl.[6] ..... B65D 1/02; B65D 1/40

[52] U.S. Cl. ..... 215/365; 215/381; 215/382; 206/459.5; 220/675

[58] Field of Search ..... 215/379, 381, 215/382, 365; 220/674, 675; 206/459.5

[56] References Cited

U.S. PATENT DOCUMENTS

| | | | |
|---|---|---|---|
| 3,550,197 | 12/1970 | Szajna et al. | 215/382 X |
| 4,155,474 | 5/1979 | Bizzarri | 215/382 X |
| 4,645,078 | 2/1987 | Reyner | 215/900 X |
| 4,722,451 | 2/1988 | Conrad | 215/365 |
| 4,887,730 | 12/1989 | Touzani | 215/901 X |
| 5,080,244 | 1/1992 | Yoshino | 215/382 X |
| 5,224,614 | 7/1993 | Bono et al. | 215/384 |
| 5,586,681 | 12/1996 | Policappelli | 220/674 |

FOREIGN PATENT DOCUMENTS

| | | | |
|---|---|---|---|
| 2109845 | 4/1990 | Japan | 206/459.5 |

*Primary Examiner*—Sue A. Weaver
*Attorney, Agent, or Firm*—Donald R. Fraser

[57] ABSTRACT

A plastic container comprises an upper section including a neck portion, a closed base section, and a central section interconnecting the upper and base sections. The central section comprises an elastically deformable, substantially cylindrical sidewall, including indicia embossed therein. The embossed indicia substantially assumes the configuration of the sidewall when the container is pressurized, and extends away from the sidewall when the container is depressurized.

11 Claims, 1 Drawing Sheet

CONTAINER HAVING DISAPPEARING AND REAPPEARING INDICIA

This application is filed under the provisions of 35 U.S.C. Section 111(a) and claims the benefits of a provisional patent application Ser. No. 60/022,651 filed Jul. 26, 1996 under the provisions of 35 U.S.C. Section 111(b).

FIELD OF THE INVENTION

This invention relates generally to a container having disappearing and reappearing indicia. More particularly, the invention is directed to a plastic container having indicia formed in a surface thereof, which indicia selectively disappears and reappears when the container is pressurized and depressurized, respectively.

BACKGROUND OF THE INVENTION

It is desirable, for advertising and product identification purposes, that designs, logos, messages, and other ornamental and decorative features appear on the outer surfaces of plastic containers used for packaging carbonated and otherwise pressurized products.

Another desire of manufacturers of carbonated beverage products is to have access to packaging options which can be used in conjunction with promotional sales programs, whereby the container label or cap, or some other feature of the package, can be used to notify the consumer that he or she is a winner in the promotional contest; but only following the purchase and use of the contained products by the consumer. For example, "under the cap" printing is often used for such sales promotions, whereby the consumer must first purchase the beverage product and then open that product before discovering whether the package is a "winner" by reading the printed message on the underside of the cap. Other conventional packages use "tear off" labels, whereby the consumer learns whether he or she is a "winner" by tearing off a serrated portion of a double layered label, where the message is not visible before the label is torn off.

SUMMARY OF THE INVENTION

Accordant with the present invention, a plastic container having disappearing and reappearing indicia has surprisingly been discovered. In the illustrated embodiment of the invention, the container comprises an upper section including a neck portion, a closed base section, and a central section interconnecting the upper section and the base section, the central section comprising an elastically deformable, substantially cylindrical sidewall, the sidewall including embossed indicia, the indicia substantially assuming the configuration of the sidewall when the container is pressurized, and the indicia extending away from the sidewall when the container is depressurized.

The plastic container of the present invention is particularly well suited for holding carbonated beverages, and revealing embossed indicia when the carbonated beverage container is depressurized.

BRIEF DESCRIPTION OF THE DRAWINGS

The novel features which are characteristic of the present invention are set forth with particularity in the appended claims. The invention itself, however, both as to structure and method of use will best be understood from the accompanying description of a specific embodiment when read in connection with the drawings, in which:

DETAILED DESCRIPTION OF THE PREFERRED EMBODIMENT

The present invention is directed to a plastic container having disappearing and reappearing indicia. It comprises an upper section including a neck portion, a closed base section, and a central section interconnecting the upper and base sections. The central section comprises an elastically deformable, substantially cylindrical sidewall. The sidewall includes embossed indicia which substantially assumes the configuration of the sidewall when the container is pressurized, and which extends away from the side wall when the container is depressurized.

Figure 1:
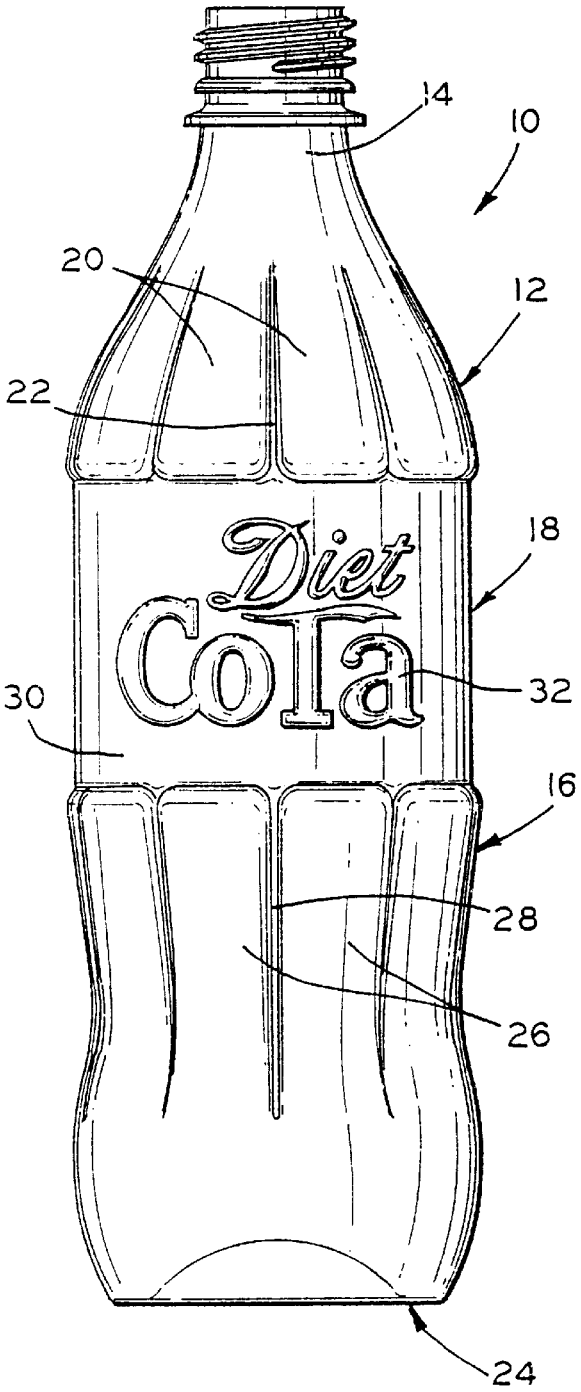
FIG. 1 is an elevational view of an embodiment of an unpressurized plastic container having exposed indicia on the central section thereof, according to the present invention.

Referring now to the Drawings, there is shown generally at 10 of FIG. 1 a plastic container incorporating the features of the present invention. The container is preferably formed by conventional means from a thermoplastic polymer having gas barrier properties that make the container 10 suitable for containing a carbonated beverage; at least throughout the expected shelf-life of the contained beverage. A number of materials having these properties have been developed. A preferred material for forming the container according to the present invention is polyethylene terephthalate, also known as "PET." A suitable PET material is sold by Shell Oil Company under the product designation PET NO. 8006.

The container 10 is typically blow-molded from an extruded or injection molded preform or parison, and has preferably been so worked that the material is biaxially oriented. The container 10 typically includes an upper section 12 including a neck portion 14, a closed base section 16, and a central section 18 which interconnects and lies intermediate the upper section 12 and closed base section 16. The neck portion 14 may have any desired neck finish such as, for example, the threaded configuration illustrated in FIG. 1. In a preferred embodiment of the present invention, the upper section 12 includes a plurality of parallel flutes 20 separated by intermediate grooves 22. The closed base section 16 includes a flat substantially annular surface 24 upon which the container 10 rests. The closed base section 16 also contains a plurality of parallel flutes 26 separated by intermediate grooves 28.

The central section 18 comprises an elastically deformable, substantially cylindrical sidewall 30, including indicia 32 which is embossed therein. The indicia 32 may be embossed or otherwise formed into the substantially cylindrical sidewall 30 when the container 10 is initially formed in such a manner that it extends or projects away from the substantially cylindrical sidewall 30, either inwardly toward the interior of the container 10 or outwardly away from the interior of the container 10. As will be readily apparent to one ordinarily skilled in the art, the indicia 32 may be of any form or style, and may comprise words, symbols, images, and the like. In the embodiment illustrated in FIG. 1, the indicia 32 comprises a trademark of a beverage company.

The flutes 20 and 26 and their associated grooves 22 and 28, respectively, are functional as well as aesthetic features. More specifically the grooves 22 and 28 provide flow conduits for moisture that condenses on the exterior of the container 10, thereby allowing the flutes 20 and 26 to be at least partially free from moisture when the container 10 is grasped by the hand of a consumer. Moreover, the flutes 20 and 26 and their associated grooves 22 and 28, respectively, cooperate to lend rigidity to the container 10, particularly in the unpressurized state.

Figure 2:
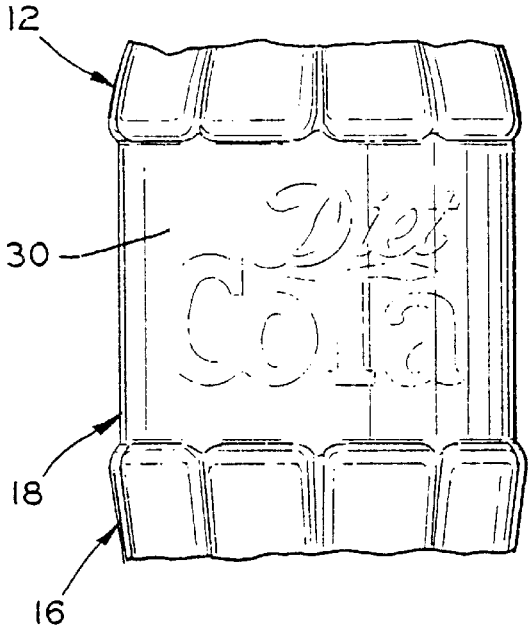
FIG. 2 is a partial elevational view of the plastic container illustrated in FIG. 1, but in a pressurized condition, according to the present invention.

FIG. 2 illustrates a portion of the container of FIG. 1 in the pressurized state. Specifically FIG. 2 illustrates that the indicia 32 substantially assumes the configuration of the substantially cylindrical sidewall 30 when a liquid is placed in the container 10 under pressure and the container 10 is sealed at its neck portion 14 so as to cause the fluid within the container 10 to maintain an outward pressure against the interior surface of the container 10. Thus, the indicia 32, embossed or otherwise formed into the sidewall 30 of the container 10, becomes substantially invisible to a consumer viewing the pressurized container 10. Moreover, the central section 18 of the pressurized container 10 presents a substantially smooth cylindrical surface, upon which a trademark or advertising/marketing information may easily be printed, or against which a manufacturers label may be adhered.

In operation, when a consumer ultimately loosens the neck portion 14 closure, thereby allowing the container 10 to become depressurized, the indicia 32 extends away from the substantially cylindrical sidewall 30 and becomes visible to the consumer. Thus, the indicia 32, which had "disappeared" upon pressurization of the container 10, "reappears" when the container is depressured, assuming its originally-embossed configuration.

It must be noted that the flutes 20 and 26 and their associated grooves 22 and 28, respectively, maintain substantially the same configuration when the container 10 is in the pressurized and unpressurized states, as illustrated in the FIGURES.

The sidewall 30 of the central section 18 is significantly more susceptible to flexing and distortion upon pressurization and depressurization of the container 10. This difference in elasticity may be achieved by conventional methods such as, for example, by forming the sidewall 30 of the central section 18 thinner than the walls of the upper and base sections 12 and 16, by utilizing a different, more elastic composition or material for the central section 18 than for the upper and base sections 12 and 16, etc.

The present invention may conveniently be used for advertising and product identification purposes wherein indicia carried upon a container may be formed as a convex or concave feature in the container sidewall by blow-molding the container into a mold cavity which contains the reverse geometry of the desired indicia. Thus the sidewall of the central section may be formed by causing the hot plastic material to conform to the inner surface of the cold mold cavity. Depending upon the thickness, material of construction, and magnitude of the pressure used to pressurize the container, such indicia will be easily visible when the container is ultimately depressured.

Accordingly, the present invention contemplates a novel container which, when pressurized, results in a central section sidewall that is substantially smooth and cylindrical due to the elasticity of the central section sidewall material thus masking or causing to "disappear" any advertising, product identifications, special messages, designs, or other indicia initially embossed or formed into the sidewall or the central section. Thereafter, upon depressurization of the container, the embossed indicia would "reappear" and become distinguishable due to the memory of the plastic material from which the central section was made.

In the illustrated embodiment of the invention, the indicia is formed in the central section of a container wherein there is provided an annular array of flutes at both the bottom and the top of the central section. It must be understood that the indicia could likewise be formed in the shoulder and/or the base portions of a container. In this regard, the central section of the container could extend over the entire length of the container from the neck portion to the closed base section. Accordingly, the inventive concept is considered to function wherever the side wall of the container is pressurized and can elastically deform.

The invention is more easily comprehended by reference to the specific embodiments herein which are representative of the invention. It must be understood, however, that the specific embodiments are provided only for the purpose of illustration and that the invention may be practiced otherwise than as specifically illustrated without departing from its spirit and scope.

What is claimed is:

1. A plastic container, comprising an upper section including a neck portion, a closed base section, and a central section interconnecting the upper section and the base section, said central section comprising an elastically deformable, substantially cylindrical sidewall, said sidewall including embossed indicia, said indicia substantially assuming the configuration of said sidewall when said container is pressurized, and said indicia extending away from said sidewall when said container is depressurized.

2. The plastic container according to claim 1, wherein the plastic is a thermoplastic.

3. The plastic container according to claim 1, wherein the plastic is polyethylene terephthalate.

4. The plastic container according to claim 1, wherein the plastic is biaxially oriented.

5. The plastic container according to claim 1, wherein the neck portion has a threaded configuration.

6. The plastic container according to claim 1, wherein the upper section includes a plurality of parallel flutes separated by intermediate grooves.

7. The plastic container according to claim 1, wherein the closed base section included a plurality of parallel flutes separated by intermediate grooves.

8. The plastic container according to claim 1, wherein the indicia extends away from the sidewall toward the interior of the plastic container.

9. The plastic container according to claim 1, wherein the indicia extends away from the sidewall away from the interior of the plastic container.

10. The plastic container according to claim 1, wherein the sidewall of the central portion is thinner than the walls of the upper and base sections.

11. The plastic container according to claim 1, wherein the sidewall of the central section has a composition that is different than the composition of the upper and base sections.

* * * * *